US011830370B2

(12) United States Patent
da Costa Mello et al.

(10) Patent No.: US 11,830,370 B2
(45) Date of Patent: Nov. 28, 2023

(54) METHODS, SYSTEMS, AND APPARATUSES FOR COMPUTATION AND ANNUNCIATION OF MACH TUCK

(71) Applicant: HONEYWELL INTERNATIONAL INC., Charlotte, NC (US)

(72) Inventors: Paulo da Costa Mello, Phoenix, AZ (US); Anil Kumar Songa, Bangalore (IN); Kalimulla Khan, Bangalore (IN); Kantha Chikkegowda, Bangalore (IN)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 111 days.

(21) Appl. No.: 17/450,299

(22) Filed: Oct. 8, 2021

(65) Prior Publication Data

US 2023/0062812 A1 Mar. 2, 2023

(30) Foreign Application Priority Data

Aug. 25, 2021 (IN) ..... 202111038510

(51) Int. Cl.
*G08G 5/00* (2006.01)

(52) U.S. Cl.
CPC ..... *G08G 5/0039* (2013.01); *G08G 5/0021* (2013.01)

(58) Field of Classification Search
CPC ..... G08G 5/0039; G08G 5/0021
See application file for complete search history.

(56) References Cited

U.S. PATENT DOCUMENTS

| | | | |
|---|---|---|---|
| 2,522,337 | A | 9/1950 | Walter |
| 2,537,240 | A | 1/1951 | Shaw |
| 5,341,677 | A | 8/1994 | Maris |
| 2003/0222795 | A1 | 12/2003 | Holforty et al. |
| 2017/0060141 | A1 | 3/2017 | Leopold et al. |

(Continued)

FOREIGN PATENT DOCUMENTS

| | | | |
|---|---|---|---|
| EP | 314838 | A1 | 5/1989 |
| EP | 3478582 | A1 | 5/2019 |
| WO | 2016191320 | A1 | 12/2016 |

OTHER PUBLICATIONS

"Mach 1: Assaulting the Barrier", Stephan Wilkinson, Air and Space Magazine, Smithsonian Magazine, Dec. 1, 1990.*

*Primary Examiner* — Andrew W Bee
(74) *Attorney, Agent, or Firm* — Lorenz & Kopf LLP

(57) ABSTRACT

Methods, systems, and apparatuses provided for predicting a Mach Tuck situation. The method includes generating a flight plan for the aircraft of at least one supersonic flight path segment in accordance with a flight plan criteria entered via an input interface wherein the aircraft traverses at least one supersonic flight path segment at an airspeed approaching or exceeding a supersonic airspeed; predicting based on an impact of a weather condition forecast to occur at a selected region of the supersonic flight path segment while the aircraft is operating at the airspeed approaching or exceeding the supersonic speed that an overpressure condition will occur causing an aerodynamic effect to the aircraft that results in the aircraft exceeding an operating limitation causing the Mach Tuck situation; and modifying the flight plan in a manner to lessen the impact of the weather condition forecast to occur to prevent the Mach Tuck situation.

13 Claims, 4 Drawing Sheets

(56) References Cited

U.S. PATENT DOCUMENTS

| | | | | |
|---|---|---|---|---|
| 2019/0127079 | A1 | 5/2019 | Ribeiro et al. | |
| 2019/0137326 | A1* | 5/2019 | Suddreth | G01H 17/00 |
| 2019/0272762 | A1* | 9/2019 | Suddreth | G08G 5/0021 |
| 2020/0033185 | A1 | 1/2020 | Suddreth et al. | |
| 2020/0066171 | A1 | 2/2020 | Prosser et al. | |
| 2021/0055111 | A1 | 2/2021 | Bhan et al. | |

* cited by examiner

Navigation Display

Primary Flight Display

MACH TUCK Depiction

METHODS, SYSTEMS, AND APPARATUSES FOR COMPUTATION AND ANNUNCIATION OF MACH TUCK

CROSS REFERENCE TO RELATED APPLICATION

This application claims priority to India Provisional Patent Application No. 202111038510, filed Aug. 25, 2021, the entire content of which is incorporated by reference herein.

TECHNICAL FIELD

The subject matter described herein generally relates to vehicle systems, and more particularly, embodiments of the subject matter are related to aircraft systems for predicting an adverse aerodynamic effect causing an aircraft's nose to pitch downward while the aircraft's airspeed approaches or exceeds a supersonic airspeed wherein the adverse aerodynamic effect includes a Mach Tuck situation.

BACKGROUND

Regulatory authorities currently restrict over-land supersonic flight of civilian aircraft (A/C) throughout much of the populated world. In the United States, for example, current Federal Aviation Administration regulations prohibit supersonic flight of civilian A/C over land. Such restrictions are generally motived by noise abatement rationale and a desire to protect ground structures, such as building windows, from damage due to the pressure waves generated during supersonic air travel. These concerns notwithstanding, regulatory authorities have indicated that existing supersonic over-land flight restrictions might soon be eased, within limits.

Mach Tuck is an aerodynamic effect, whereby the nose of an aircraft tends to pitch downwards as the airflow around the wing reaches supersonic speeds. The Mach Tuck situation can cause an aerodynamic stall due to an over-speed condition which is different than the more common stalls that experience insufficient airspeed, increased angles of attack, excessive load factors, or a combination of those causes. When an aircraft's airspeed is below Mach 1.0 and as the aircraft airspeed approaches a critical Mach number there can occur, an aerodynamic effect to the aircraft's frame where the accelerated airflow over the upper surface of the wing exceeds Mach 1.0. This can result in a shock wave and as the shock wave passes over the aircraft's wing upper surface, the accelerated airflow returns from a supersonic to a subsonic airflow creating an overpressure event causing a loss of lift.

Also, when an aircraft is operating at a subsonic airspeed but with an airspeed but close to supersonic airspeeds, the aircraft's frame can encounter weather condition related events that cause brief periods of turbulence or wind gusts over certain aircraft parts or sections of the aircraft's frame that may exceed the critical Mach number resulting in an adverse aerodynamic effect known as Mach Tuck. With the easement of supersonic flight regulations over the landmass, a commercial aircraft that is flying at or close to a supersonic airspeed could unintentionally enter this phenomenon resulting in a Mach Tuck situation and also can cause a sonic boom to be experienced over the landmass.

There is a lack of Mach Tuck awareness and annunciation to the flight crew in advance of a weather condition that can cause the Mach Tuck when the aircraft is engaged in a supersonic flight phase. For example, current cockpit display systems provide little advance notice of the impact of the weather condition in causing the Mach Tuck when the aircraft is navigating a supersonic flight segment. Also, there is little if any information provided to the flight crew in a region on a navigation display of the aircraft approaching a Mach Tuck number or zonal annunciation in the region that due to a weather event there is a likelihood of experiencing a Mach Tuck situation.

Accordingly, it desirable to improve pilot situational awareness of Mach Tuck, to prevent an aircraft from entering into a Mach Tuck situation, and to mitigate undesirable sonic booms from occurring over a landmass by implementing processes and system of computation and annunciation of Mach Tuck and sonic boom alerts with aircraft systems.

Other desirable features and characteristics will become apparent from the subsequent detailed description and the appended claims, taken in conjunction with the accompanying drawings and the foregoing technical field and background.

BRIEF SUMMARY

Methods, systems, and apparatuses are provided for predicting and indicating a Mach tuck situation.

One exemplary method provides a method carried out by an avionic system of an aircraft for predicting a Mach Tuck situation. The method includes generating a flight plan for the aircraft that includes at least one supersonic flight path segment in accordance with a flight plan criteria entered via an input interface that includes the aircraft traversing at least one supersonic flight path segment at an airspeed approaching or exceeding a supersonic airspeed, predicting based on an impact of a weather condition forecast to occur at a selected region of the supersonic flight path segment while the aircraft is operating at the airspeed approaching or exceeding the supersonic speed that an overpressure condition will occur causing an aerodynamic effect to the aircraft that results in the aircraft exceeding an operating limitation causing the Mach Tuck situation; and in response to a predicted weather condition forecast in the selected region of the supersonic flight path segment, modifying the flight plan in a manner to lessen the impact of the weather condition forecast to occur to prevent the aircraft from incurring the Mach Tuck situation.

In at least one exemplary embodiment, the method provides generating a corresponding visual notification on a display device that depicts a region associated with the Mach Tuck situation and a flight path generated by the flight plan of the aircraft.

In at least one exemplary embodiment, the method provides computing the impact of the weather condition forecast to occur based on a set of data including a critical Mach Tuck number for the aircraft, collected weather information on the flight path, and supersonic and subsonic airspeeds of the aircraft while operating in the region associated with the Mach Tuck situation.

In at least one exemplary embodiment, the method provides modifying the flight path of the aircraft to circumvent the region associated with the Mach Tuck situation.

In at least one exemplary embodiment, the method provides highlighting the region of the predicted Mach Tuck situation on a cockpit display system in the flight path of the aircraft with relevant information including source information and information about that weather condition in the region that can cause the Mach Tuck situation while the aircraft is approaching or operating in a supersonic flight phase.

In at least one exemplary embodiment, the method provides annunciating a predicted value of an aircraft's airspeed when at least approaching the supersonic flight phase.

In at least one exemplary embodiment, the method provides annunciating the predicted value of the aircraft's airspeed when at least operating at a subsonic airspeed approaching a supersonic airspeed to provide an alert of a likelihood for incurring the Mach Tuck situation.

In at least one exemplary embodiment, the method provides enabling preventive actions to avert the Mach Tuck situation by presenting a series of increased alerts of the Mach Tuck situation in an upcoming flight phase wherein the series of increased alerts provide enhanced situational awareness about a likelihood for incurring the Mach Tuck situation.

In another exemplary embodiment, a flight planning system deployed onboard an aircraft capable of at least approaching a supersonic airspeed to predict a Mach Tuck Situation is provided. The flight planning system includes a wireless datalink; and a controller architecture coupled to the wireless data link, the controller architecture configured to: via the wireless data link, transmit requests to a remote entity for weather forecast data based upon flight parameters of the aircraft at intervals along a flight plan containing at least one flight plan segment wherein the aircraft operates at an airspeed that at least approaches the supersonic airspeed; utilize the weather forecast data received from the remote entity to calculate an impact of a weather condition forecast to occur at a selected region corresponding to the at least one flight plan segment wherein the aircraft is operating at the airspeed approaching or exceeding the supersonic speed; predict based on a calculated impact of the weather condition forecast to occur that an overpressure event causing an aerodynamic effect to the aircraft that can cause the aircraft to exceed an operating flight limitation resulting in the Mach Tuck situation in response to a predicted weather condition forecast in the selected region of the supersonic flight path segment, modify the flight plan in a manner to lessen the calculated impact of the weather condition forecast to occur to prevent the aircraft from incurring the Mach Tuck situation.

In at least one exemplary embodiment, the flight planning system includes a display device coupled to the controller architecture; wherein the controller architecture is further configured to generate a visual notification on the display device that depicts a region associated with the Mach Tuck situation and flight plan segment of the aircraft.

In at least one exemplary embodiment, the flight planning system includes the controller architecture configured to compute the impact of a weather condition based on a set of data including a critical Mach Tuck number for the aircraft, collected weather information, and supersonic and subsonic aircraft's airspeeds of aircraft while operating in the region associated with the Mach Tuck situation.

In at least one exemplary embodiment, the flight planning system includes the controller architecture configured to modify the flight plan of the aircraft to circumvent the region associated with the Mach Tuck situation in a manner that lessens the impact of the weather condition to prevent the Mach Tuck situation.

In at least one exemplary embodiment, the flight planning system includes the controller architecture configured to highlight the region of the predicted Mach Tuck situation on the display device associated with the flight plan segment to display corresponding relevant information at least about the weather condition forecast to occur in the region associated with the Mach Tuck situation.

In at least one exemplary embodiment, the flight planning system includes the controller architecture configured to enable preventive actions to avert the Mach Tuck situation by presenting a series of increased alerts of the Mach Tuck situation in an upcoming flight phase wherein the series of increased alerts provide enhanced situational awareness about a likelihood for incurring the Mach Tuck situation.

In yet another exemplary embodiment, an apparatus to predict a Mach Tuck situation is provided. The apparatus includes at least one processor deployed on a computing device, the at least one processor programmed to transmit requests to a source for weather forecast data based upon aircraft flight parameters at intervals along a flight plan containing at least one flight plan segment wherein the aircraft operates at an airspeed that at least approaches the supersonic airspeed; utilize the weather forecast data received from the source to calculate an impact of a weather condition forecast to occur at a selected region corresponding to the at least one flight plan segment wherein the aircraft is operating at the airspeed approaching or exceeding the supersonic speed; predict based on a calculated impact of a weather condition that an overpressure event will occur causing an aerodynamic effect to the aircraft that can cause the aircraft to exceed an operating limitation resulting in the Mach Tuck situation; and in response to a predicted weather condition forecast at the selected region corresponding to the at least one flight plan segment wherein the aircraft is operating at the airspeed approaching or exceeding the supersonic speed of the supersonic flight path segment, modify the flight plan in a manner to lessen the calculated impact of the weather condition forecast to occur to prevent the aircraft from incurring the Mach Tuck situation.

In at least one exemplary embodiment, the apparatus includes at least one processor programmed to: generate a corresponding visual notification on a display device that depicts a region associated with the Mach Tuck situation and flight plan segment of the aircraft.

In at least one exemplary embodiment, the apparatus includes at least one processor programmed to: generate a visual notification on the display device that depicts a region associated with the Mach Tuck situation and a flight plan segment of the aircraft that circumvents the Mach Tuck situation.

In at least one exemplary embodiment, the apparatus includes at least one processor programmed to compute the impact of the weather condition based on a set of data including a critical Mach Tuck number for the aircraft, collected weather information, and supersonic and subsonic aircraft's airspeeds of aircraft while operating in the region associated with the Mach Tuck situation.

In at least one exemplary embodiment, the apparatus includes at least one processor programmed to: modify the flight plan of the aircraft to circumvent the region associated with the Mach Tuck situation in a manner that lessens the impact of the weather condition to prevent the Mach Tuck situation.

In at least one exemplary embodiment, the apparatus includes at least one processor programmed to highlight the region of the predicted Mach Tuck situation on the display device associated with the flight plan segment to display corresponding relevant information at least about the weather condition forecast to occur in the region associated with the Mach Tuck situation.

BRIEF DESCRIPTION OF THE DRAWINGS

Embodiments of the subject matter will hereinafter be described in conjunction with the following drawing figures, wherein like numerals denote like elements, and.

DETAILED DESCRIPTION

Figure 1:
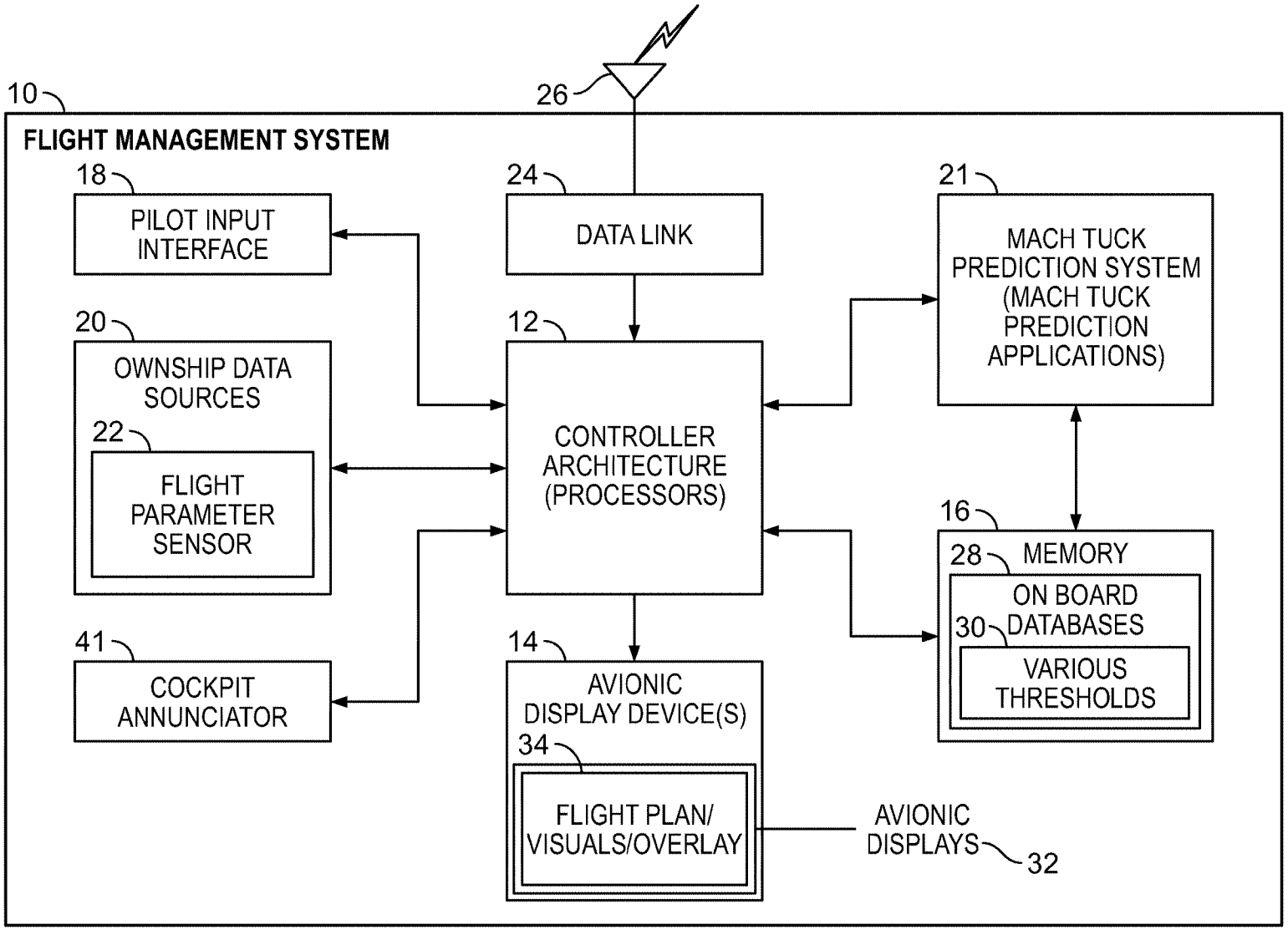
FIG. 1 is a block diagram of an avionic system, which supports enhanced supersonic flight planning through the impact of weather forecast data and which is illustrated in accordance with an exemplary embodiment of the present disclosure.

The following Detailed Description is merely exemplary in nature and is not intended to limit the invention or the application and uses of the invention. The term "exemplary," as appearing throughout this document, is synonymous with the term "example" and is utilized repeatedly below to emphasize that the description appearing in the following section merely provides multiple non-limiting examples of the invention and should not be construed to restrict the scope of the invention, as set out in the Claims, in any respect. As further appearing herein, the term "pilot" encompasses all users of the below-described aircraft system.

As used herein, the term "present" refers broadly to any means or method for the distribution of information to a flight crew or other aircraft operator, whether visually, aurally, tactilely, or otherwise.

An aircraft operating at a subsonic airspeed or local aerodynamic flow conditions is where $M<1.0$ results in its local flow Mach number is approximately 0.8. When the aircraft is in a Transonic flight or supersonic flight, its local flow Mach number $M\geq1.0$. Transonic flight conditions are assumed when the Mach number lies in the range $0.8<M<1.2$. The greatest degree of aerodynamic unpredictability is associated with the Mach number range for supersonic flight. In supersonic flight with aerodynamic flow conditions when $M>1.0$ everywhere in the local flow field. As with transonic conditions, supersonic flow conditions are assumed when the free stream Mach number is greater than approximately 1.2. At the critical Mach number for an aircraft, shock waves begin to form at various places on the airframe and are accompanied by an abrupt reduction in local lift, abrupt increase in local drag, and some associated change in pitching moment. As the Mach number is increased from a low value the speed of the air over the wing increases steadily until at some point the speed reaches the local speed of sound; this Mach number is known as the 'critical Mach number' for the aircraft.

Embodiments of the subject matter described herein generally relate to systems, methods, and apparatuses for graphically depicting a Mach Tuck situation that may be encountered by an aircraft in a flight path while in subsonic aircraft flight and transitioning or approaching supersonic speeds. Further, when approaching supersonic speeds and encountering brief periods of turbulence or wind gusts, parts of an aircraft can experience airspeeds that exceed a critical Mach number resulting in a Mach Tuck situation.

While the subject matter described herein could be utilized in various applications or the context of various types of vehicles (e.g., aircraft, drones, or the like), exemplary embodiments are described herein in the context of depicting the operating vehicles with respect to a flight plan operating close to supersonic speeds. In this regard, exemplary embodiments may be described herein primarily in the context of aircraft; however, it should be appreciated the subject matter described herein is not limited to any particular type or combination of vehicles.

In various exemplary embodiments, the present disclosure provides methods, systems, and apparatuses for monitoring weather services both onboard and offboard such as pilot reports (PIREPS), Meteorological Aerodrome Reports (METARS), and other sources to find weather disruptions or clear air turbulence along the flight path and predict the impact of this type of weather disruption at the airspeed of an aircraft in a supersonic flight phase. If the airspeed is predicted to exceed a critical Mach and reach Mach 1 along the flight path (several Nautical miles (Nm) from the Aircraft), appropriate alerting is provided to the crew to prevent the aircraft from coming into a Mach Tuck situation.

Various different data sources and analysis techniques may be employed by the flight planning system in obtaining Mach Tuck-related forecast data, which is then utilized to determine a Mach Tuck region and associated flight plan to avoid a Mach Tuck situation.

In certain embodiments, the flight planning system may retrieve Mach Tuck predictions from a remote entity, such as a cloud-based service or server farm, dedicated to performing relatively complex forecasting algorithms. The flight planning system may submit queries to the remote entity for forecast data based upon projected flight parameters at selected intervals along with an initially-generated, flight plan; and receive, in return, forecast data to determine Mach Tuck situations and sonic boom occurrences in a supersonic flight segment.

In various exemplary embodiments, the present disclosure describes presenting the wake turbulence and Mach Tuck region alerts on the HUD (Head-Up Display) for better situational awareness. Also, once a wake turbulence threat is detected, methods and systems are provided to enable corrective actions to be executed by the crew to prevent operating in the Mach Tuck situation or to prevent or lessen impacts of weather disruptions causing the Mach Tuck situation as the aircraft approaches or continues at supersonic airspeeds along a flight path in the Mach Tuck region.

Referring now to FIG. 1, FIG. 1 is a block diagram of a flight planning system, as illustrated in accordance with an exemplary and non-limiting embodiment of the present disclosure. The avionics system (e.g., Flight Management System (FMS)) 10 may assist in the generation of flight plans that circumvent a weather-related Mach Tuck situation in a flight path. Also, the avionics system 10 may prevent or lessen the impact of a sonic boom experienced when the aircraft approaches a supersonic airspeed (i.e., Mach 1) or continues in the supersonic airspeed (especially when flying over a landmass). The flight plans created to circumvent a Mach Tuck situation or to prevent or lessen a sonic boom for one or more aircraft; e.g., avionics system 10 may be utilized to generate flight plans for a non-illustrated aircraft, which carries or is equipped with a system for flight management.

As schematically depicted in FIG. 1, avionics system 10 includes the following components or subsystems, each of which may assume the form of a single device or multiple interconnected devices: a controller architecture 12, at least one avionic display device 14, computer-readable storage media or memory 16, and a pilot input interface 18. avionics system 10 may further contain aircraft data sources 20 including, for example, an array of flight parameter sensors 22. avionic system 10 may also contain a datalink subsystem 24 including an antenna 26, which may wirelessly transmit data to and receive data from various sources external to the avionic system 10, such as a cloud-based forecasting service of the type discussed below.

Although schematically illustrated in FIG. 1 as a single unit, the individual elements and components of the flight planning system can be implemented in a distributed manner utilizing any practical number of physically distinct and operatively interconnected pieces of hardware or equipment. When avionic system 10 is utilized to construct supersonic flight plans for a manned aircraft, the various components of the flight planning system will typically all be located onboard the aircraft. Comparatively, in implementations in which the avionics system 10 is utilized to construct flight plans for a remotely-controlled UAV or aircraft, certain components of avionics systems 10 may be carried by the UAV, while other components may be situated at the ground-based station or facility from which the UAV is piloted. For example, in this latter instance, display device(s) 14, pilot input interface 18, and some portion of memory 16 may be located offboard the UAV.

The term "controller architecture," as appearing herein, broadly encompasses those components utilized to carry out or otherwise support the processing functionalities of flight planning system or avionics system 10. Accordingly, controller architecture 12 can encompass or may be associated with any number of individual processors, flight control computers, navigational equipment pieces, computer-readable memories (including or in addition to memory 16), power supplies, storage devices, interface cards, and other standardized components. Controller architecture 12 may include or cooperate with any number of firmware and software programs (generally, computer-readable instructions) for carrying out the various process tasks, calculations, and control/display functions described herein. Controller architecture 12 may exchange data with one or more external sources to support the operation of avionics system 10 in embodiments. In this case, bidirectional wireless data exchange may occur over a communications network, such as a public or private network implemented in accordance with Transmission Control Protocol/Internet Protocol architectures or other conventional protocol standards. Encryption and mutual authentication techniques may be applied, as appropriate, to ensure data security.

In an exemplary embodiment, the controller architecture 12 can integrate or communicate with a Mach Tuck prediction system 21 that can predict based on an impact of a weather condition forecast to occur at a selected region of the supersonic flight path segment the likelihood that the aircraft will incur a Mach Tuck situation. That is, the Mach Tuck prediction system may apply Mach Tuck prediction application (e.g., airspeed prediction applications) to determine while the aircraft is operating at an airspeed approaching or exceeding the supersonic speed that an overpressure condition will occur because of a weather disruption or like, and this, in turn, will or may cause an adverse aerodynamic effect experienced by the aircraft that results in the aircraft exceeding an operating limitation (i.e., a critical Mach Number) causing the Mach Tuck situation. For example, the Mach Tuck prediction system 21 can be configured to compute the impact of the weather condition forecast to occur based on a set of data that can include a critical Mach Tuck number for the aircraft, collected weather information on the flight path, and supersonic and subsonic airspeeds of the aircraft while operating in the region associated with the Mach Tuck situation.

In an exemplary embodiment, the controller architecture 12 can be coupled to an annunciator 41 and the annunciator 41 can be configured to annunciate a predicted value of an aircraft's airspeed when approaching the supersonic flight phase or an alert associated with an impending Mach Tuck situation. Also, the annunciator 41 can annunciate the audible alerts of the impending Mach Tuck situation configured in a manner to increase in magnitude and frequency based on analysis of the weather condition impact in a designated Mach Tuck region and as the aircraft flight path is determined to more likely to incur the Mach Tuck situation. The annunciator 41 can provide audible alerts in advance that correspond to visual alerts provided on the avionic display 32 and are coordinated with the analysis of flight data from flight parameter sensors 22 or other ownship data sources 20.

Memory 16 can encompass any number and type of storage media suitable for storing computer-readable code or instructions, as well as other data generally supporting the operation of avionics system 10. In certain embodiments, memory 16 may contain one or more databases 28, such as geographical (terrain), runway, navigational, and historical weather databases, which may be updated on a periodic or iterative basis to ensure data timeliness. The databases maintained in memory 16 may be shared by other systems onboard the aircraft carrying avionics system 10, such as an Enhanced Ground Proximity Warning System (EGPWS) or a Runway Awareness and Advisory System (RAAS). Memory 16 may also store one or more values associated with the below-described tolerance threshold calculated to assess the impact of weather destruction to the aircraft approaching a critical Mach Number or thresholds with other calculations such as the likelihood of a sonic wave that causes a sonic boom, as generically represented by box 30. Finally, in at least some implementations of avionics system 10, one or more Mach Tuck profiles or sonic wave profiles specific to the ownship aircraft (i.e., the critical Mach number) or, perhaps, a range of aircraft types may be stored within memory 16.

Flight parameter sensors 22 supply various types of data or measurements to controller architecture 12 during aircraft flight. A non-exhaustive list of such data or measurements includes initial reference system measurements, Flight Path Angle (FPA) measurements, airspeed data, groundspeed data, altitude data, attitude data including pitch data and roll measurements, yaw data, data related to aircraft weight, time/date information, heading information, data related to atmospheric conditions, flight path data, flight track data, radar altitude data, geometric altitude data, wind speed and direction data, and fuel consumption data. Further, in certain embodiments of avionics system 10, controller architecture 12 and the other components of avionics system 10 may be included within or cooperate with any number and type of systems commonly deployed onboard aircraft including, for example, an Attitude Heading Reference System (AHRS), an Instrument Landing System (ILS), and/or an Inertial Reference System (IRS), to list but a few examples.

With continued reference to FIG. 1, the avionic display device 14 (or devices 14) can include any number and type of image generating devices on which one or more avionic displays may be produced. When the avionics system 10 is utilized to construct flight plans for a manned aircraft, display device 14 may be affixed to the static structure of the aircraft cockpit as, for example, a Head Down Display (HDD) or Head-Up Display (HUD) unit. Alternatively, the display device 14 may assume the form of a movable display device (e.g., a pilot-worn display device) or a portable display device, such as an Electronic Flight Bag (EBB), a laptop, or a tablet computer carried into the aircraft cockpit by a pilot. Similarly, when avionic system 10 is utilized to construct flight plans for and to pilot a UAV or remotely-piloted aircraft, the display device 14 may be realized as an HDD or HUD unit affixed to the static structure of a control facility, as a portable electronic device carried into such a control facility by a pilot, or as a movable display device worn by a pilot when remotely operating the UAV.

At least one avionic display 32 is generated on display device 14 during operation of avionic system 10; the term "avionic display" is defined as synonymous with the term "aircraft-related display" and encompassing displays generated in textual, graphical, cartographical, and other formats. Avionic display 32 is generated to include various visual elements or graphics 34, which may be referenced by a pilot during the supersonic flight planning process. Graphics 34 can include, for example, textual readouts relating to entered flight plan criteria or text annunciations indicating whether avionics system 10 is likely to incur the impact of a weather disruption that can cause a Mach Tuck situation or able to generate a sonic boom-regulated flight plan satisfying such criteria. The avionic display or displays generated by avionics system 10 can include alphanumerical input displays of the type commonly presented on the screens of MCDUs, as well as Control Display Units (CDUs) generally. avionics system 10 can also generate various other types of displays on which symbology, text annunciations, and other graphics pertaining to flight planning, information related to a Mach Tuck region, the impact of a weather disruption based on weather forecast data to a supersonic flight phase, and to the projected occurrence of the aircraft to incur a Mach Tuck situation on a current flight path or to incur excessive sonic booms. For example, embodiments of avionics system 10 can generate graphics 34 on one or more two dimensional (2D) avionic displays, such as a horizontal or vertical navigation display; and/or on one or more three dimensional (3D) avionic displays, such as a Primary Flight Display (PFD) or an exocentric 3D avionic display. An exemplary method, which is suitably implemented by avionics system 10 in performing processing tasks related to Muck Tuck prediction, prevention and/or circumvention (if weather-related), and to sonic boom predictions, reductions, and preventions, will now be described in conjunction with FIG. 2.

Figure 2:
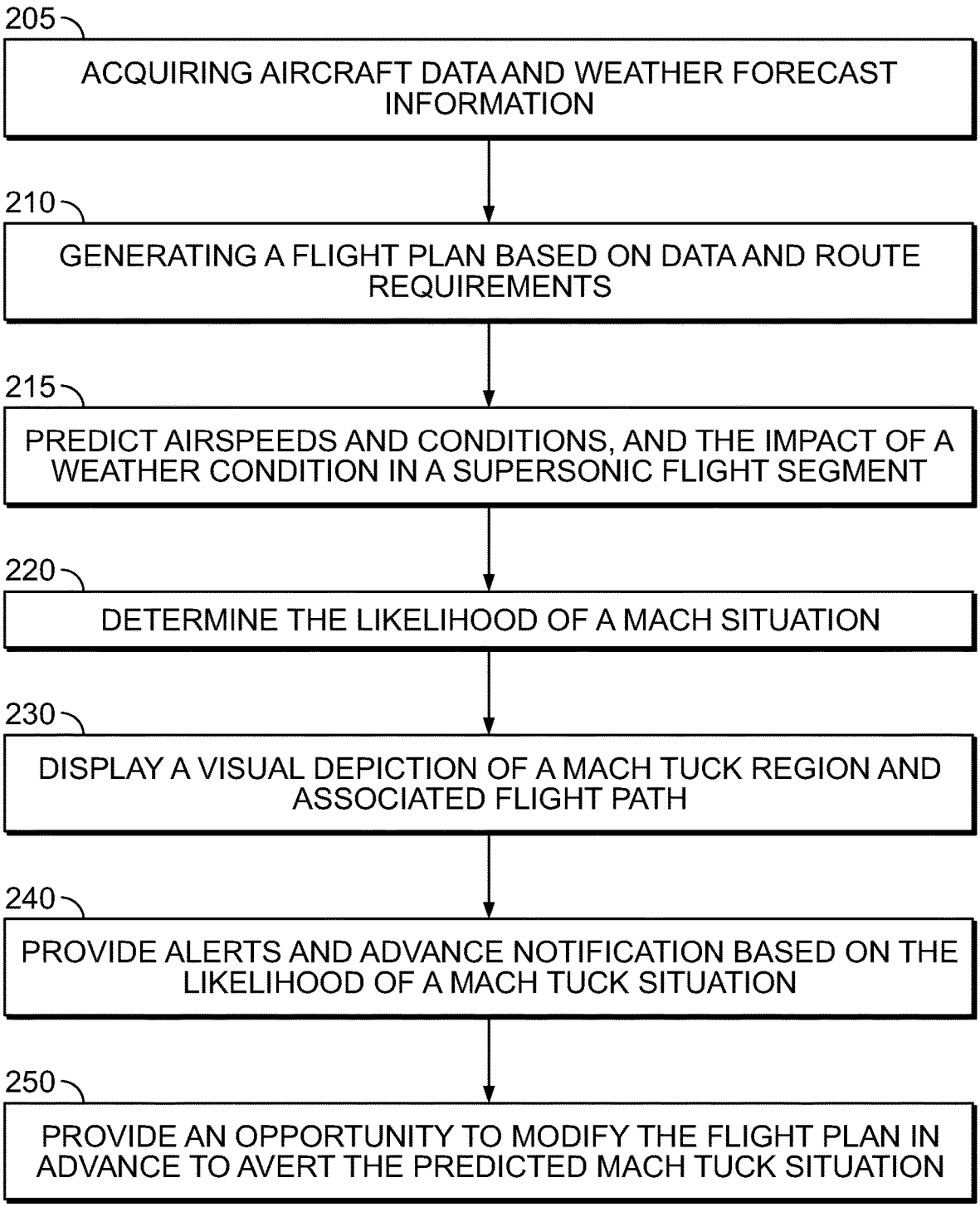
FIG. 2 is a flowchart of a method suitably carried out by the avionic system shown in FIG. 1 when receiving requests to generate flight plans including supersonic flight plan segments, as further illustrated in accordance with an exemplary embodiment of the present disclosure.

FIG. 2 is a flowchart setting forth an exemplary method, which can be carried out by avionics system 10 (FIG. 1) to enhance or augment supersonic flight planning through the integration of Mach Tuck and sonic boom forecast data into the flight planning process. In this example, the flight planning method includes a number of computer-implemented functions or process steps identified. Depending upon the particular manner in which the method is implemented, each illustrated step may entail a single process or multiple sub-processes. The steps shown in FIG. 2 and described below are provided by way of non-limiting examples only. In other embodiments of the method, additional process steps may be performed, certain steps may be omitted, and/or the illustrated steps may be performed in alternative sequences.

The flight planning method commences at STEP 205 with the acquiring of aircraft data and forecast weather condition information of weather in the planned flight path. For example, as shown in Table 1, aircraft data acquired can include aircraft data for a critical Mach number dependent on the type of aircraft and attributes associated with aircraft type that can cause a lesser or greater Maximum Mach.

TABLE 1

Example of Aircraft Critical Mach Number

| Aircraft | Max Mach |
|---|---|
| G650 | Mach 0.90 |
| G700 | Mach 0.92 |
| A380 | Mach 0.88 |
| A380 | Mach 0.96 |
| B787 | Mach 0.90 |
| B777 | Mach 0.84 |
| B747 | Mach 0.84 to 0 88 |
| Dassault Falcon 900LX | Mach 0.87 |
| F8X | Mach .90 |
| F7X | Mach 0.90 |
| G500 | Mach 0.925 |

At STEP 210, a flight plan is generated by the avionics system 10. The flight plan contains at least one supersonic flight plan segment; that is, a segment or portion of the flight plan calling for supersonic aircraft flight. The flight plan is generated in accordance with specified flight plan criteria, which can be entered into avionics system 10 by a pilot utilizing input interface 18. Such flight plan criteria can include a starting waypoint, an ending waypoint, an estimated time of departure (ETD), and other relevant parameters. A pilot may manually program such flight plan criteria into avionics system 10, which may include or assume the form of an avionics system, utilizing a designated physical interface or Graphic User Interface (GUI). For example, in one embodiment, the designated pilot input interface can be an alphanumeric keypad provided on an MCDU or any other input user interface devices such as MFD, Touch screen controller and etc. Afterward, the pilot may review the MCDU display screen to ensure accurate entry of the flight plan parameters and then utilize the MCDU keypad to submit the flight plan to the avionics suite of the aircraft. Alternatively, the flight plan parameters may be automatically submitted to an avionics system or, more generally, avionic system 10 from another device, such as an EFB or tablet, utilized for pre-planning purposes. Such a process is still considered pilot entry in the present context as a pilot will initiate this data transfer process. As a still further possibility, avionic system 10 may be implemented utilizing such an EFB, tablet, or other portable electronic device and may interface with (rather than include) the avionic system 10 when performing the process tasks described herein.

With continued reference to FIG. 2, the flight planning method next advances to predicting the airspeed or other predictions at STEP 215 (via the Mach Tuck prediction system 21) during which the avionic system 10 determines whether the flight plan based on inputs about the aircraft performance and weather data will encounter a Mach Tuck situation on a supersonic flight segment when the aircraft approaches or exceeds Mach 1 in the flight plan.

In an exemplary embodiment, the avionic system monitors weather services both onboard and offboard such as PIREPS, METARS, and other sources to find weather disruptions or clear air turbulence along the flight path and predict via the Mach Tuck prediction system 21 the impact of the same on the airspeeds. If the airspeed is predicted to exceed critical Mach and reach Mach 1 along the flight path (several nautical miles (nm) from the Aircraft), appropriate alerting is provided to the crew to prevent the aircraft from getting into the Mach Tuck situation.

The airspeed prediction application that can be integrated with the Mach Tuck prediction system 21 will also determine the likelihood of a sonic wave and that a sonic boom will occur over a landmass along with the flight plan. Stated differently, during the prediction process, the avionic system 10 assesses whether any sonic booms predicted to occur during execution of the flight plan are sufficiently limited to conform with certain configured or regulated boom tolerance thresholds that are allowed in the airspace.

At STEP 220, based on the predicted airspeeds in a supersonic flight phase, the Mach Tuck prediction system 21 determines the likelihood of a Mach Tuck situation based on the impact of the weather disruption (i.e., the impact of the weather event on the aircraft's airspeed). At STEP 220 of the flight planning method, the avionic system 10 utilizes performance models to project future aircraft flight parameters at selected intervals along the supersonic flight plan segment or segments of the flight plan. In embodiments, avionic system 10 may project the relevant aircraft flight parameters, and retrieve the weather forecast data, at intervals along with the flight plan. For example, avionic system 10 may project flight parameters for all supersonic flight plan segments at intervals having a relatively tight spacing and, perhaps, the minimum spacing permitted by the resolution of a terrain database included in databases 28 (of FIG. 1). The flight parameters projected by avionic system 10 can be determined utilizing established aircraft performance models, as well as other pertinent data inputs including forecasted wind and weather conditions. The flight parameters projected by avionic system 10 can include the FPA, speed, altitude, horizontal location (longitude and latitude), and any other parameter influencing sonic boom-production at each examined juncture or interval of supersonic flight plan segments.

As indicated above, avionic system 10 utilizes the projected flight parameters to determine whether a Mach Tuck situation, sonic boom, or overpressure event is predicted at each interval along with the supersonic flight plan segments. In certain implementations, avionic system 10 may retrieve weather forecast data from a remote entity, such as a cloud-based service or server farm, dedicated to performing relatively complex forecasting algorithms Specifically, in this case, avionic system 10 may submit "what-if" queries to such a remote entity, with such queries soliciting weather forecast data and related information pertinent to determining Mach Tuck situations at the selected intervals based upon the projected flight parameters. The avionic system 10 may then receive, in return, the weather forecast data for each flight plan internal under consideration. In addition to indicating whether a Mach Tuck situation is anticipated to occur, other forecast data can be retrieved that include sonic boom forecast data. Further, the sonic boom forecast data may also data that indicates the severity (e.g., pressure or decibel level) of a predicted sonic boom and perhaps other information associated therewith, such as data describing the projected propagation of the sonic boom through three-dimensional space. By outsourcing the predictions from avionic system 10 to a remote entity, computationally-intensive forecasting algorithms can be performed by the remote external entity to increase the speed and accuracy with which the predictions are generated, while minimizing processing demands placed on controller architecture 12. This notwithstanding, avionic system 10 can independently generate the forecast data.

In certain embodiments, aircraft-specific profiles may be further taken into account when generating the forecast data during STEP 220 to determine the impact of the weather condition in a supersonic flight segment. When so considered, such aircraft-specific profiles may generally represent or emulate the general three-dimensional pressure wave shape created by a particular aircraft when traveling at supersonic speeds above the below-described Mach cutoff speed. The profile for a given aircraft may be constructed based on the physical characteristics of the aircraft including, for example, aircraft shape, weight class, and engine configuration. The avionic system 10 may store one or more aircraft-specific profiles in memory 16 and recall such profiles during the method.

If the Mach Tuck prediction system 21 determines that the generated flight plan may incur a Mach Tuck situation because as an example a weather condition or turbulence, the avionic system 10 can visually depict at STEP 230 a region in the flight path via an overlay that shows a region correlated with a supersonic flight segment of the aircraft where there is a likelihood of a certain magnitude or threshold that is indicative that a Mach Tuck situation can occur.

In an exemplary embodiment, the avionic system 10 enables a real-time computation and depiction of Mach Tuck alert on a Primary Flight Display (PFD) and a navigation display. The computation or prediction of a Mach Tuck event is performed by the Mach Tuck prediction system 21 using applications to predict the airspeed (of STEP 210) of the aircraft in the supersonic flight segment. The Mach Tuck prediction system 21 has access to the flight plan and the Aircraft state parameters to monitor the flight path as well as the current airspeed. The information on upcoming weather disruptions or turbulence is extracted from onboard weather radar or live weather service providers like XM weather, GDC, PIREPS, METARS, etc. . . . . By correlating the weather condition along the flight path and by an assessment of the impact to the airspeed, the airspeed is predicted based on the aircraft performance and/or Historical performance.

At STEP 240, an alert or a series of alerts of different magnitudes and frequency can be generated by Mach Tuck prediction system 21, and also (corresponding) audible alerts can be presented by the annunciator 41 to provide advanced notice to the flight crew of a predicted Mach Tuck situation in the current flight plan. Also, similar alert notices can be provided for sonic booms in advance by the Mach Tuck prediction system 21. When the airspeed is predicted to exceed critical Mach and reach Mach 1 due to the up-coming weather disruption, it is annunciated by the annunciator 41 in the PFD speed tape with the predicted value of the airspeed if the anomaly is not addressed by modifying the flight plan, etc. . . . . This information would allow the crew to take preventive action to avert the event/incident that can cause the Mach Tuck situation.

At STEP 250, in an exemplary embodiment, the avionic system 10 can receive inputs or changes in view of the predicted results based on the likelihood of a Mach Tuck situation and modify the flight plan by carrying out iterative processes to arrive at a flight plan that reduces or entirely eliminates the likelihood of a Mach Tuck situation. Alternately, via manual input, the pilot can modify the flight plan to avert or avoid a likelihood that the aircraft in a supersonic flight segment will experience a Mach Tuck situation of varying degrees.

In an alternate exemplary embodiment, the flight plan can be modified through iterations directed to regulate the sonic boom likely to be experienced in the flight plan or to keep the sonic boom within acceptable limits based on an airspeed in a modified flight plan while still conforming to other requirements like time to reach a waypoint, slot times, etc. to a destination.

In various embodiments, avionic system 10 may generate visual alerts or otherwise provide pilot notification if a predicted overpressure event, or a Mach Tuck situation, or excessive sonic boom can be resolved, but only through a relatively significant deviation in aircraft parameters, such as a pronounced change in altitude or speed. It may be desirable to notify a pilot of pronounced reductions in speed, for example, due to the negative impact of such speed reductions on fuel economy and aircraft range. In conjunction with notifying a pilot of relatively pronounced speed reduction, avionic system 10 may also afford the pilot with an opportunity to instead perform other pre-emptive modification to the flight plan, such as minor adjustments in altitude, to avert the Mach Tuck situation prediction, the excessive sonic boom prediction or anticipated overpressure event. Similarly, if determining that a predicted overpressure event can be resolved, but only through a relatively large deviation in altitude from the original altitude at a particular internal along with the flight plan, avionic system 10 may again generate an advisory message on the display device 14 or require pilot confirmation before modifying the flight plan.

Figure 3:
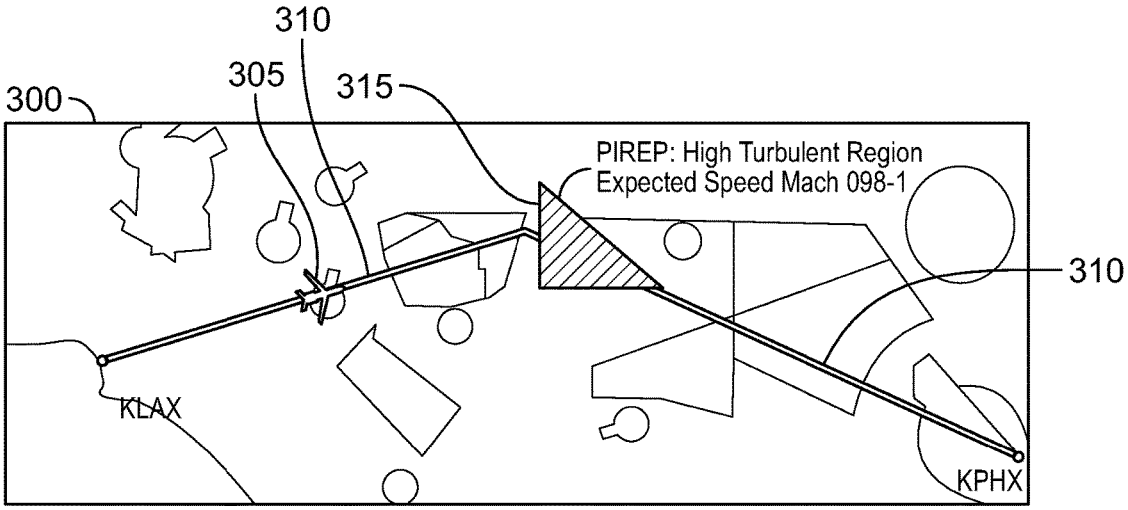
FIG. 3 is a screenshot of a navigational display including graphics aiding in supersonic flight planning, as to be generated by the avionic system (e.g., flight management system) of FIG. 1 when implementing the method of FIG. 2 is an exemplary embodiment of the present disclosure.

FIG. 3 is a screenshot of a navigational display including graphics aiding in supersonic flight planning, as to be generated by the avionic system of FIG. 1 when implementing the method of FIG. 2 is an exemplary embodiment of the present disclosure.

In FIG. 3, the Mach Tuck warning and alert is depicted in an overlay (highlighted) region 315 designating an area of high turbulence in the navigation display 300 in the flight path 310 of the aircraft 305. The overlay region 315 in the flight path in a region that is determined by the prediction system there is likely or expected that a Mach Tuck situation can occur based on the aircraft airspeed in the overlay region and the weather conditions. In this case, the weather conditions include labeling indicative of a turbulent condition. The overlay region 315 also includes the source of the weather information (PIREP, METAR, etc.) in the labeling, its area of impact, and the expected airspeed of the aircraft (i.e., Mach 0.98 to 1.0) in the region. As explained above, the flight crew with the alert information that includes visual markings of the impacted region can modify the flight plan in advance to circumvent or reduce the area of impact to avoid the likelihood of the predicted Mach Tuck situation based on the current aircraft operating parameters and turbulence detected in the region. In an exemplary embodiment, the Mach Tuck situation can be warned to the flight crew by aural alerts that can be configured increases in levels and frequency as the aircraft approaches the impacted overlay region 315 to provide multiple levels of warnings to crew similar to other warning systems in the aircraft.

In an exemplary embodiment, the alerts associated with the Mach Tuck (and sonic boom occurrence) can be configured consistent with flight crew warnings that provide timely attention-getting cues through multiple different senses by combinations of aural, visual, or tactile indications, for the crew that includes alerts requiring immediate flight crew awareness, and provide the flight crew by the labeling and information associated with the overlay region needed to identify the Mach Tuck alert causes (weather condition, airspeed, and impacted area) and to determine the appropriate corrective action to avoid the impacted area.

In an exemplary embodiment, the alerts with the Mach Tuck and/or sonic boom occurrence alerts can be configured in a prioritization hierarchy based upon the urgency of flight crew awareness and urgency of flight crew response required. For example, the Mach Tuck alert can be configured as a warning based on the aircraft's airspeed and sensed weather conditions that require immediate flight crew awareness and immediate flight crew response.

In an exemplary embodiment, the alert can be configured as a warning which is time-critical to maintain the immediate safe operation of the airplane and prioritized higher than other warnings in the cockpit. Also, the alert can be configured with a lesser level of priority such as a caution alert for a Mach Tuck situation that is less likely to occur in the flight path, or far removed from the current location of the aircraft in the flight path requiring subsequent action, not in the immediate future. The alert may be configured as an advisory where a Mach Tuck situation had occurred or may occur for crew awareness but not requiring any responsive actions on the part of the crew to respond. conditions that require immediate flight crew awareness and subsequent flight crew response (e.g., the Mach Tuck alert is presented as an aural alert to caution the crew of the impediment in the flight path).

Figure 4:
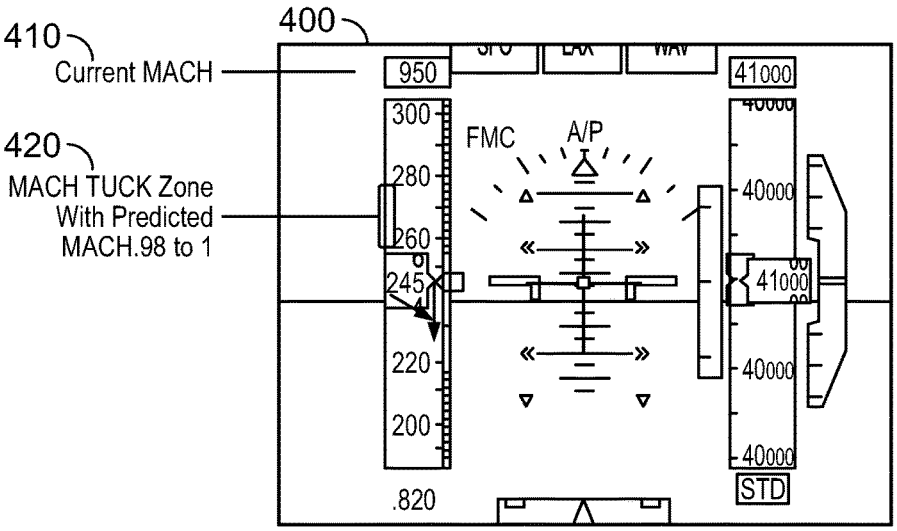
FIG. 4 is a screenshot of an avionic display including graphics aiding in supersonic flight planning, as to be generated by the avionic system of FIG. 1 when implementing the method of FIG. 2 is an exemplary embodiment of the present disclosure.

FIG. 4 is a screenshot of a graphic user interface (GUI) in a navigational cockpit display of a Mach Tuck depiction including heading information which may be generated on avionic display 32 by avionic system 10 in a further exemplary embodiment of the present disclosure. The avionic system 10 plots a first or primary flight plan which is generated based upon entered flight plan criteria. The depicted flight plans are superimposed over a map view presented from, for example, a forward-looking, three-dimensional perspective. The forward-looking or heading perspective includes customary graphics in a forward heading display 400 including, for example, an aircraft graphic, a current Mach display 410, a Mach Tuck zone 420 with predicted Mach of 0.98 to 1.0 ranges, and various symbols indicative of heading, terrain, range, and structures (not shown for clarity).

Figure 5:
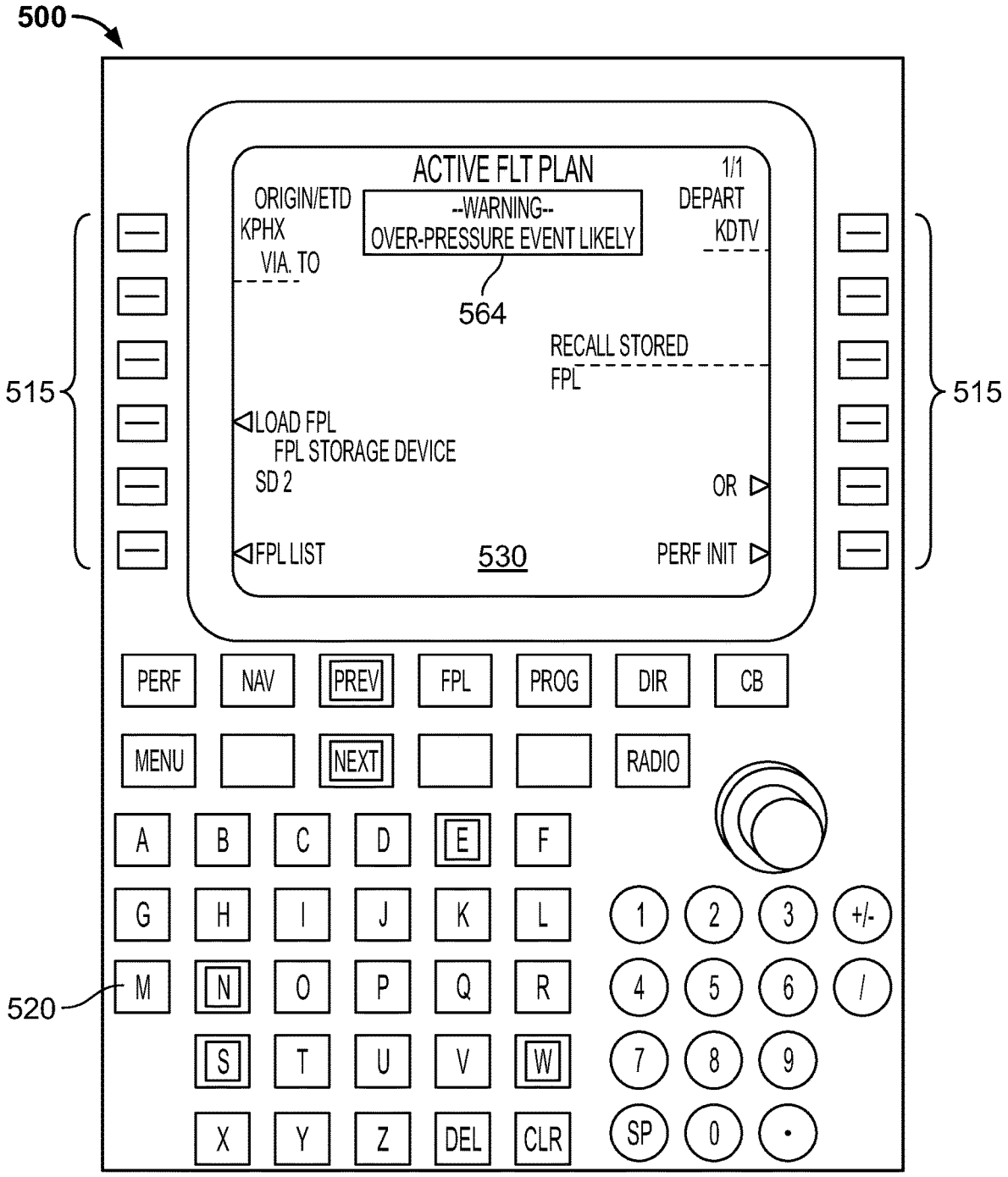
FIG. 5 depicts an exemplary Multifunction Control and Display Unit (MCDU), which may be utilized as a pilot interface of the flight planning system of FIG. 1 in an exemplary embodiment of the present disclosure.

FIG. 5 illustrates an MCDU (or other exemplary input devices including a MFD, TSC, Touch DU or any other suitable input device etc.) 500, which can be utilized as an input device and display device of avionics system 10 shown in FIG. 1 in an embodiment. In the illustrated embodiment, MCDU 500 includes a display screen 530, a number of command-line buttons 515 arranged in two columns on opposing sides of the display screen 530, an alphanumeric keypad located beneath screen 520, and various other inputs. The Multi-Function Control and Display Unit (MCDU) 500 allows alphanumeric input data, such as flight plan criteria, to be entered by a pilot into avionics system 10 during the initial stages of supersonic flight planning. As indicated in an upper portion of FIG. 5, a notification 564 can be presented on display screen 530 when the avionics system 10 determines a Mach Tuck situation can occur in the flight plan based on the entered flight plan criteria. In this particular example, notification 564 is generated as a text annunciation warning of the Mach Tuck situation because a turbulence event is predicted if the flight plan is executed without modification. In other embodiments, such a notification can vary in appearance and be produced on a different type of display in addition to or in lieu of display 530. Further, in certain implementations, avionics system 10 may also generate other graphics aiding in pilot assessment and decision making when advising of a Mach Tuck prediction. Such graphics can include, for example, symbology presenting one or more alternative (detoured) flight plans terminating at the desired ending waypoint while averting the Mach Tuck situation.

Although an exemplary embodiment of the present disclosure has been described above in the context of a fully-functioning computer system (e.g., avionics system 10 described above in conjunction with FIGS. 1-5), those skilled in the art will recognize that the mechanisms of the present disclosure are capable of being distributed as a program product (e.g., an Internet-disseminated program or software application) and, further, that the present teachings apply to the program product regardless of the particular type of computer-readable media (e.g., hard drive, memory card, optical disc, etc.) employed to carry-out its distribution. In certain implementations, the avionic system may include GUI components, such as ARINC 661 and new ARINC 661 Part 2 components, which may include a User Application Definition File ("UADF"). As will be appreciated by one skilled in the art, such a UADF is loaded into the flight planning system and defines the "look and feel" of the display, the menu structure hierarchy, and various other static components of the GUI with which a pilot or other user interacts.

For the sake of brevity, conventional techniques related to flight planning, drone detection, graphics and image processing, avionics systems, and other functional aspects of the systems (and the individual operating components of the systems) may not be described in detail herein. Furthermore, the connecting lines shown in the various figures contained herein are intended to represent exemplary functional relationships and/or physical couplings between the various elements. It should be noted that many alternative or additional functional relationships or physical connections may be present in an embodiment of the subject matter.

The subject matter may be described herein in terms of functional and/or logical block components, and with reference to symbolic representations of operations, processing tasks, and functions that may be performed by various computing components or devices. It should be appreciated that the various block components shown in the figures may be realized by any number of hardware components configured to perform the specified functions. For example, an embodiment of a system or a component may employ various integrated circuit components, e.g., memory elements, digital signal processing elements, logic elements, look-up tables, or the like, which may carry out a variety of functions under the control of one or more microprocessors or other control devices. Furthermore, embodiments of the subject matter described herein can be stored on, encoded on, or otherwise embodied by any suitable non-transitory computer-readable medium as computer-executable instructions or data stored thereon that, when executed (e.g., by a processing system), facilitate the processes described above.

The foregoing description refers to elements or nodes or features being "coupled" together. As used herein, unless expressly stated otherwise, "coupled" means that one element/node/feature is directly or indirectly joined to (or directly or indirectly communicates with) another element/node/feature, and not necessarily mechanically. Thus, although the drawings may depict one exemplary arrangement of elements directly connected to one another, additional intervening elements, devices, features, or components may be present in an embodiment of the depicted subject matter. In addition, certain terminology may also be used herein for the purpose of reference only, and thus are not intended to be limiting.

The foregoing detailed description is merely exemplary in nature and is not intended to limit the subject matter of the application and uses thereof. Furthermore, there is no intention to be bound by any theory presented in the preceding background, brief summary, or the detailed description.

Terms such as "comprise," "include," "have," and variations thereof are utilized herein to denote non-exclusive inclusions. Such terms may thus be utilized in describing processes, articles, apparatuses, and the like that include one or more named steps or elements but may further include additional unnamed steps or elements. While at least one exemplary embodiment has been presented in the foregoing detailed description, it should be appreciated that a vast number of variations exist. It should also be appreciated that the exemplary embodiment or exemplary embodiments are only examples and are not intended to limit the scope, applicability, or configuration of the subject matter in any way. Rather, the foregoing detailed description will provide those skilled in the art with a convenient road map for implementing an exemplary embodiment of the subject matter.

It should be understood that various changes may be made in the function and arrangement of elements described in an exemplary embodiment without departing from the scope of the subject matter as set forth in the appended claims. Accordingly, details of the exemplary embodiments or other limitations described above should not be read into the claims absent a clear intention to the contrary.

What is claimed is:

1. A method carried out by an avionics system of an aircraft for predicting a Mach Tuck situation, comprising:

generating a flight plan for the aircraft that comprises at least one supersonic flight path segment in accordance with a flight plan criteria entered via an input interface that includes the aircraft traversing the at least one supersonic flight path segment at an airspeed approaching or exceeding a supersonic airspeed;

predicting based on an impact of a weather condition forecast to occur at a selected region of the supersonic flight path segment while the aircraft is operating at the airspeed approaching or exceeding the supersonic speed that an overpressure condition will occur causing an aerodynamic effect to the aircraft that results in the aircraft exceeding an operating limitation causing the Mach Tuck situation;

in response to a predicted weather condition forecast in the selected region of the supersonic flight path segment, modifying the flight plan in a manner to lessen the impact of the weather condition forecast to occur to prevent the aircraft from incurring the Mach Tuck situation;

generating a corresponding visual notification on a display device that depicts the region associated with the Mach Tuck situation and a flight path generated by the flight plan of the aircraft; and computing the impact of the weather condition forecast to occur based on a set of data comprising a critical Mach Tuck number for the aircraft, collected weather information on the flight path, and supersonic and subsonic airspeeds of the aircraft while operating in the region associated with the Mach Tuck situation.

2. The method of claim 1, further comprising:

modifying the flight path of the aircraft to circumvent the region associated with the Mach Tuck situation.

3. The method of claim 2, further comprising:

highlighting the region of the predicted Mach Tuck situation on the display device in the flight path of the aircraft with relevant information comprising source information and information about that weather condition in the region that can cause the Mach Tuck situation while the aircraft is approaching or operating in a supersonic flight phase.

4. The method of claim 3, further comprising:

annunciating a predicted value of an aircraft's airspeed when at least approaching the supersonic flight phase.

5. The method of claim 4, further comprising:

annunciating the predicted value of the aircraft's airspeed when at least operating at a subsonic airspeed approaching the supersonic airspeed to provide an alert of a likelihood for incurring the Mach Tuck situation.

6. The method of claim 4, further comprising:

enabling preventive actions to avert the Mach Tuck situation by presenting a series of increased alerts of the Mach Tuck situation in an upcoming flight phase wherein the series of increased alerts provide enhanced situational awareness about a likelihood for incurring the Mach Tuck situation.

7. A flight planning system deployed onboard an aircraft capable of at least approaching a supersonic airspeed to predict a Mach Tuck Situation, the flight planning system comprising:

a wireless data link;

a display device; and a controller architecture coupled to the wireless data link and the display device, the controller architecture configured to:

via the wireless data link, transmit requests to a remote entity for weather forecast data based upon flight parameters of the aircraft at intervals along a flight plan containing at least one flight plan segment wherein the aircraft operates at an airspeed that at least approaches the supersonic airspeed;

utilize the weather forecast data received from the remote entity to calculate an impact of a weather condition forecast to occur at a selected region corresponding to the at least one flight plan segment wherein the aircraft is operating at the airspeed approaching or exceeding the supersonic speed;

predict based on the calculated impact of the weather condition forecast to occur that an overpressure event causing an aerodynamic effect to the aircraft that can cause the aircraft to exceed an operating flight limitation resulting in the Mach Tuck situation;

in response to a predicted weather condition forecast in the selected region, modify the flight plan in a manner to lessen the calculated impact of the weather condition forecast to occur to prevent the aircraft from incurring the Mach Tuck situation;

generate a visual notification on the display device that depicts a region associated with the Mach Tuck situation and the at least one flight plan segment of the aircraft; and compute the impact of a weather condition based on a set of data comprising a critical Mach Tuck number for the aircraft, collected weather information, and supersonic and subsonic aircraft's airspeeds of aircraft while operating in the region associated with the Mach Tuck situation.

8. The flight planning system of claim 7, further comprising:

the controller architecture configured to:

modify the flight plan of the aircraft to circumvent the region associated with the Mach Tuck situation in a manner that lessens the impact of the weather condition to prevent the Mach Tuck situation.

9. The flight planning system of claim 8, further comprising:

the controller architecture configured to:

highlight the region of the predicted Mach Tuck situation on the display device associated with the flight plan segment to display corresponding relevant information at least about the weather condition forecast to occur in the region associated with the Mach Tuck situation.

10. The flight planning system of claim 9, further comprising:

the controller architecture configured to:

enable preventive actions to avert the Mach Tuck situation by presenting a series of increased alerts of the Mach Tuck situation in an upcoming flight phase wherein the series of increased alerts provide enhanced situational awareness about a likelihood for incurring the Mach Tuck situation.

11. An apparatus to predict a Mach Tuck situation, the apparatus comprising:

at least one processor deployed on a computing device, the at least one processor programmed to:

transmit requests to a source for weather forecast data based upon aircraft flight parameters at intervals along a flight plan containing at least one flight plan segment wherein the aircraft operates at an airspeed that at least approaches a supersonic airspeed;

utilize the weather forecast data received from the source to calculate an impact of a weather condition forecast to occur at a selected region corresponding to the at least one flight plan segment wherein the aircraft is operating at the airspeed approaching or exceeding the supersonic speed;

predict based on the calculated impact of a weather condition that an overpressure event will occur causing an aerodynamic effect to the aircraft that can cause the aircraft to exceed an operating limitation resulting in the Mach Tuck situation;

in response to a predicted weather condition forecast at the selected region corresponding to the at least one flight plan segment wherein the aircraft is operating at the airspeed approaching or exceeding the supersonic speed of a supersonic flight path segment, modify the flight plan in a manner to lessen the calculated impact of the weather condition forecast to occur to prevent the aircraft from incurring the Mach Tuck situation;

generate a corresponding visual notification on a display device that depicts a region associated with the Mach Tuck situation and the at least one flight plan segment of the aircraft; and compute the impact of the weather condition based on a set of data comprising a critical Mach Tuck number for the aircraft, collected weather information, and supersonic and subsonic aircraft's airspeeds of aircraft while operating in the region associated with the Mach Tuck situation.

12. The apparatus of claim 11, further comprising:

the at least one processor programmed to:

modify the flight plan of the aircraft to circumvent the region associated with the Mach Tuck situation in a manner that lessens the impact of the weather condition to prevent the Mach Tuck situation.

13. The apparatus of claim 12, further comprising:

the at least one processor programmed to:

highlight the region of the predicted Mach Tuck situation on the display device associated with the flight plan segment to display corresponding relevant information at least about the weather condition forecast to occur in the region associated with the Mach Tuck situation.

* * * * *